US006822531B2

(12) United States Patent
Carlson

(10) Patent No.: US 6,822,531 B2
(45) Date of Patent: Nov. 23, 2004

(54) SWITCHED-FREQUENCY POWER DIVIDERS/COMBINERS

(75) Inventor: Brian W. Carlson, Liberty Lake, WA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/210,567

(22) Filed: Jul. 31, 2002

(65) Prior Publication Data

US 2004/0021527 A1 Feb. 5, 2004

(51) Int. Cl.[7] ..... H01P 1/10

(52) U.S. Cl. ..... 333/104; 333/101; 333/103; 333/109; 333/110; 333/116; 333/117; 333/125; 333/126; 333/128; 333/129; 333/132; 333/134

(58) Field of Search ..... 333/101, 103, 333/104, 109, 110, 116, 117, 125, 126, 128, 129, 132, 134, 120

(56) References Cited

U.S. PATENT DOCUMENTS

| | | | | | |
|---|---|---|---|---|---|
| 2,789,271 | A | * | 4/1957 | Budenbom | 333/120 |
| 3,619,787 | A | * | 11/1971 | Salzberg | 455/327 |
| 4,420,839 | A | * | 12/1983 | Hogerheiden, Jr. | 455/327 |
| 4,613,834 | A | * | 9/1986 | Heine | 333/120 |
| 4,626,806 | A | * | 12/1986 | Rosar et al. | 333/104 |
| 4,647,879 | A | * | 3/1987 | Vaddiparty | 333/127 |
| 4,721,929 | A | * | 1/1988 | Schnetzer | 333/127 |
| 4,749,969 | A | * | 6/1988 | Boire et al. | 333/120 |
| 4,901,042 | A | * | 2/1990 | Terakawa et al. | 333/127 |
| 5,237,294 | A | * | 8/1993 | Roederer et al. | 333/117 |
| 5,412,354 | A | | 5/1995 | Quan | |
| 5,455,546 | A | * | 10/1995 | Frederick et al. | 333/128 |
| 5,625,328 | A | * | 4/1997 | Coleman, Jr. | 333/116 |
| 5,847,625 | A | * | 12/1998 | Gillette | 333/127 |
| 5,872,491 | A | * | 2/1999 | Kim et al. | 333/101 |
| 5,903,827 | A | * | 5/1999 | Kennan et al. | 455/326 |
| 6,097,266 | A | * | 8/2000 | Nardozza et al. | 333/101 |
| 6,323,742 | B1 | * | 11/2001 | Ke | 333/127 |
| 6,373,349 | B2 | * | 4/2002 | Gilbert | 333/126 |
| 2003/0214365 | A1 | * | 11/2003 | Adar et al. | 333/109 |

OTHER PUBLICATIONS

David M. Pozar, University Of Massachusetts At Amherst; "Microwave Engineering" Second Edition; pp. 363–368 and pp. 401–407, (1998).

* cited by examiner

*Primary Examiner*—Michael Tokar
*Assistant Examiner*—Khai Nguyen
(74) *Attorney, Agent, or Firm*—Robert T. Martin

(57) ABSTRACT

Switchable path length coupler/dividers. Coupler/divider operation over multiple frequency bands is provided by using switchable path lengths. In one implementation, a Wilkinson-style device with switches to select different path lengths and therefore operating frequencies. In a rat-race style device, switches select races of different lengths, and therefore operating frequencies.

12 Claims, 2 Drawing Sheets

SWITCHED-FREQUENCY POWER DIVIDERS/COMBINERS

BACKGROUND OF THE INVENTION

1. Field of the Invention

The present invention pertains to the art of microwave power dividers and combiners.

2. Art Background

Power dividers and combiners are widely used in high frequency radio frequency devices. They provide isolation between coupled ports by combining an input signal with an 180 degree (half wavelength) delayed version of the input signal at the isolated port. In this manner, signals are cancelled at the isolated port. Since isolation relies on wavelength-dependent delays, these devices are typically narrow-band in nature.

As standards in electronic devices evolve, so does the desirability to have them work on different frequencies. For example, cellular telephones in the United States may wish to support both analog services centered around 860 MHz and digital services centered around 1990 MHz. Other devices may wish to make use of both 928 MHz and 2.4 GHz bands. It is very difficult to produce couplers which operate over this wide a frequency range.

SUMMARY OF THE INVENTION

Power dividers/couplers have switchable path lengths to allow operation on multiple frequency bands while maintaining performance comparable to that of a single-band design. A Wilkinson-type design features switchable path lengths to support multiple frequency bands. A rat-race design features multiple races to support multiple frequency bands.

BRIEF DESCRIPTION OF THE DRAWINGS

The present invention is described with respect to particular exemplary embodiments thereof and reference is made to the drawings in which.

DETAILED DESCRIPTION

Figure 1:
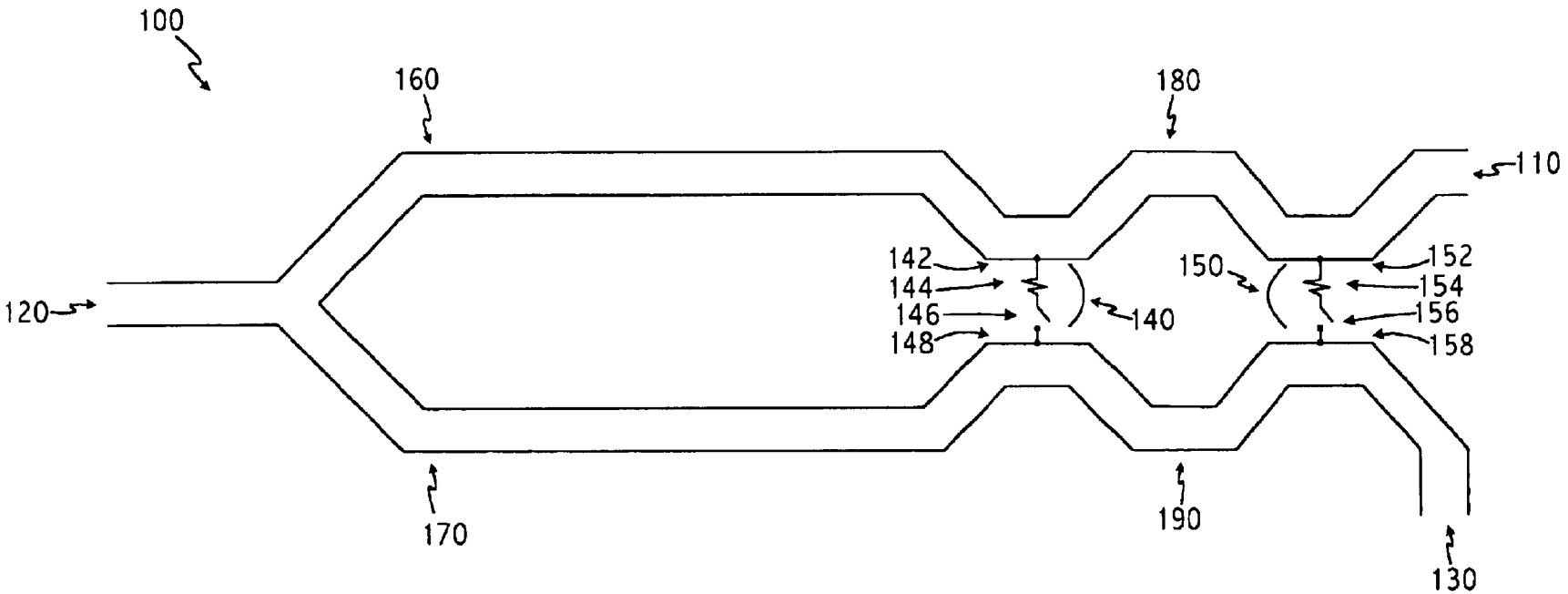
FIG. 1 shows a switched Wilkinson-style design.

With the increasing prevalence of wireless electronic devices which need to operate at widely different frequencies, power dividers/couplers are needed which provide high performance and yet support widely different frequencies. For example, in the United States, analog cellular telephone services use frequencies centered around 860 MHz, and digital cellular services use frequencies centered around 1990 MHz. Other wireless technologies make use of the 928 MHz license-free band, and the 2.4 GHz ISM band.

When faced with designs which must operate over wide frequency range, designers have in the past turned to wide-bandwidth designs. Such a design is taught, for example, by U.S. Pat. No. 5,412,354 to Quan, which discloses a double-ring hybrid magic-tee hybrid with wide bandwidth and low fabrication cost. While standard rat-race devices have a bandwidth on the order of 10% to 15%, Quan's device claims to provide a 30% bandwidth while keeping manufacturing costs low.

Still, the 30% bandwidth provided by Quan will not cover the over 2 to 1 frequency range for a combined analog (860 MHz)-digital (1990 MHz) phone, or the approximately 2.5 to 1 frequency range for a device supporting both 928 MHz and 2.4 GHz bands.

According to the present invention, rather than try and provide performance over a wide bandwidth, effective path lengths are switched to provide high performance with the ability to select between two or more highly different frequencies.

Wilkinson divider/couplers are well known to the art. By providing an odd half wavelength delay (180+n*360 degree) between two paths to the isolated port, cancellation occurs at the isolated port.

FIG. 1 shows a Wilkinson-style device according to the present invention. In a typical embodiment the device will be manufactured using tuned lines such as stripline or microstrip techniques well known to the art. The preferred embodiment makes use of microstrip techniques. Divider 100 has input port 110, output port 120, and isolated port 130. In the embodiment shown, two switching regions 140 and 150 are provided. In operation, only one switch is closed at a time. Depending on the frequency of operation and desired isolation, switches 146 and 156 will typically be implemented using PIN diodes or GaAs FET devices.

In operation, isolation at port 130 occurs when the signal between input port 110 and isolated port 130 through one of the switching regions 140 or 150 differs by one half wavelength from the signal traveling around from one side of the switch region to the other.

For example, assume switch 146 is closed. Two signal paths exist between input port 110 and isolated port 130. One path is from input port 110 through resistor 144 and switch 146 to isolated port 130. The other signal path is from input port 110 through trace 160 and trace 170 back to isolated port 130. Cancellation occurs when the difference between the path length through switch region 140 and the length of trace 160 and 170 from point 142 to point 148 is one half wavelength, providing 180 degrees of phase shift in the signal.

If switch 146 is open and switch 156 is closed, cancellation occurs when the longer path represented by traces 180, 160, 170, and 190 differs from the path through switch region 150 by one half wavelength, causing cancellation.

This design may be extended to more than two frequencies by adding additional switches. For example, a wireless digital device may wish to switch between the 928 MHz band, the 2.4 GHz band, and the 1575.42 MHz region used by GPS global positioning satellites.

Figure 2:
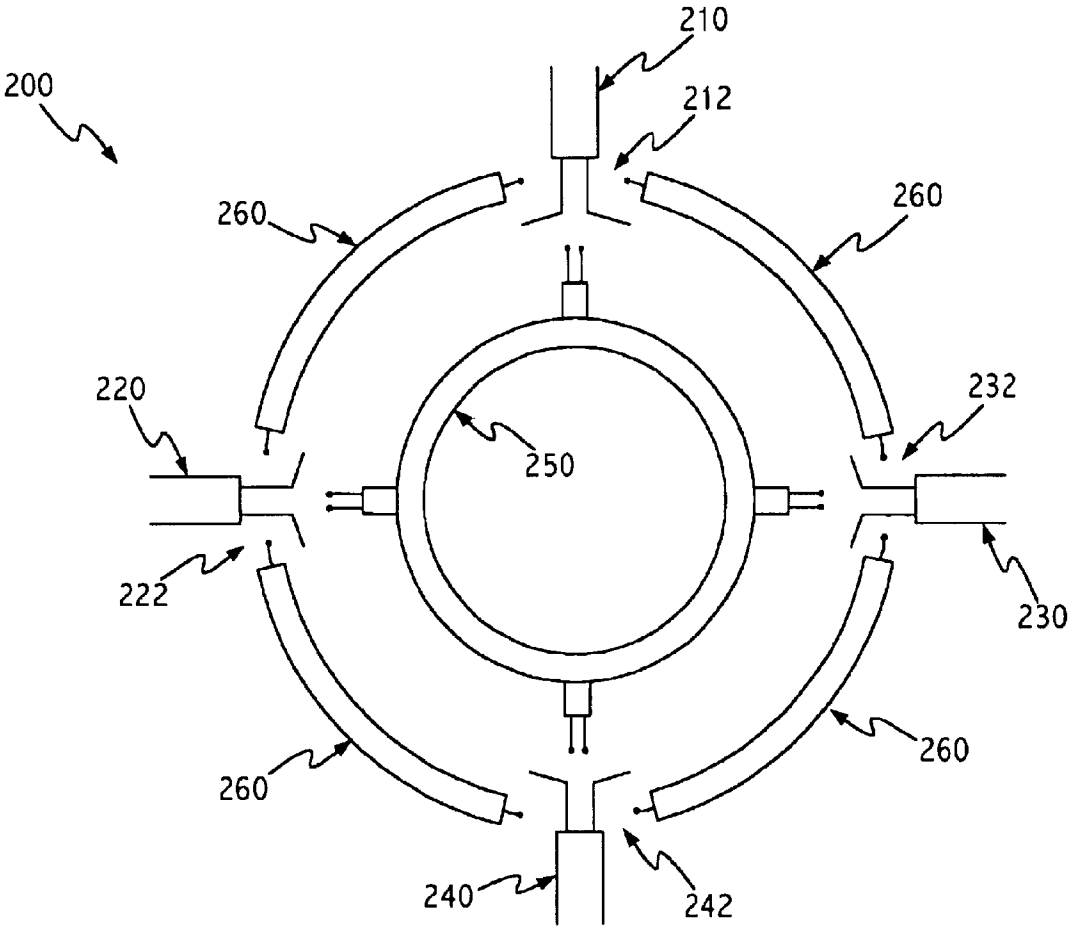
FIG. 2 shows a switched rat-race style design.

A second embodiment of the invention using a rat-race style of design is shown in FIG. 2. In a typical rat-race design, ports are connected by ¾ wavelength sections. Rat-race coupler 200 according to the present invention has input port 210, output ports 220 and 230, and isolated port 240. Inner race 250 operates at a higher frequency than outer race 260. Switch sections 212, 222, 232, and 242 operate to switch their respective ports between the inner 250 and 260 races. Tuned lines, microstrip or stripline construction is typically used, with the switches implemented using PIN diodes or GaAs FETs. While FIG. 2 shows the switch sections as double-throw switches, it is anticipated that a pair of single-throw switches would be used for each double-throw switch.

Assume the lower frequency is being used. Switch section 212 operates to connect input port 210 to outer race 260. Similarly, switch section 222 connects output port 220 to outer race 260. Switch section 232 connects output port 230 to outer race 260, and switch section 242 connects isolated port 240 to outer race 260. The sections of race 260 between switch points are ¾ wavelength at the desired operating frequency.

When operating at the higher frequency, switch sections 212, 222, 232, and 242 connect their respective ports to inner race 250. The sections of inner race 250 between the switch points are ¾ wavelength at the desired operating frequency.

The foregoing detailed description of the present invention is provided for the purpose of illustration and is not intended to be exhaustive or to limit the invention to the precise embodiments disclosed. Accordingly the scope of the present invention is defined by the appended claims.

What is claimed is:

1. A tuned line microwave coupler/divider operable on a plurality of frequency bands comprising:

an input port, an isolated port, one or more output ports, tuned lines providing a DC connection between the input port and output ports, and switching means for switching the tuned lines to operate on one of the plurality of frequency bands.

2. The coupler/divider of claim 1 where the tuned lines form a Wilkinson divider and the switching means operates to select half-wavelength points for each of the plurality of frequencies on the tuned lines.

3. The coupler/divider of claim 2 where the switching means comprises PIN diodes.

4. The coupler/divider of claim 2 where the switching means comprises field effect transistors.

5. The coupler/divider of claim 1 where the tuned lines comprise a rat-race coupler having a plurality of races.

6. The coupler/divider of claim 5 where the switching means selectively couples the input, output, and isolated ports to one of the plurality of races.

7. The coupler/divider of claim 6 where the switching means comprises PIN diodes.

8. The coupler/divider of claim 6 where the switching means comprises field effect transistors.

9. The coupler/divider of claim 1 where one of the plurality of frequency bands is the 860 MHz band.

10. The coupler/divider of claim 1 where one of the plurality of frequency bands is the 928 MHz band.

11. The coupler/divider of claim 1 where one of the plurality of frequency bands is the 1990 MHz band.

12. The coupler/divider of claim 1 where one of the plurality of frequency bands is the 2.4 GHz band.

* * * * *